United States Patent [19]

Orui et al.

[11] Patent Number: 4,855,644

[45] Date of Patent: Aug. 8, 1989

[54] CROSSED DOUBLE HELIX SLOW-WAVE CIRCUIT FOR USE IN LINEAR-BEAM MICROWAVE TUBE

[75] Inventors: Ryuzo Orui; Yasuhiro Itagaki; Toshio Yamaguchi, all of Tokyo, Japan

[73] Assignee: NEC Corporation, Japan

[21] Appl. No.: 3,197

[22] Filed: Jan. 14, 1987

[30] Foreign Application Priority Data

| | | | |
|---|---|---|---|
| Jan. 14, 1986 | [JP] | Japan | 61-6833 |
| Jan. 14, 1986 | [JP] | Japan | 61-6834 |
| Mar. 27, 1986 | [JP] | Japan | 61-70104 |
| Mar. 27, 1986 | [JP] | Japan | 61-70108 |
| Mar. 27, 1986 | [JP] | Japan | 61-70109 |
| Jun. 19, 1986 | [JP] | Japan | 61-144385 |

[51] Int. Cl.[4] ..... H01J 25/34

[52] U.S. Cl. ..... 315/3.6; 315/3.5; 315/3; 315/4

[58] Field of Search ..... 315/3.6, 3, 3.5, 5, 315/4, 39, 39.3, 39.5

[56] References Cited

U.S. PATENT DOCUMENTS

| | | | |
|---|---|---|---|
| 2,846,613 | 8/1958 | Pierce | 315/3.6 |
| 2,957,103 | 10/1960 | Birdsall | 315/3.6 |
| 2,967,259 | 1/1961 | Lagerstrom et al. | 315/3.6 |
| 3,089,975 | 5/1963 | Washburn, Jr. | 315/3.6 |
| 3,121,819 | 2/1964 | Wilmarth | 315/3.6 |
| 3,268,761 | 8/1966 | Mann | 315/3.6 |
| 3,273,081 | 9/1966 | Itzkan | 315/3.6 X |
| 3,315,118 | 4/1967 | Muller | 315/3.6 |
| 3,413,512 | 11/1968 | Buck | 315/3.6 X |
| 3,760,223 | 9/1973 | Jasper, Jr. | 315/3.6 |

*Primary Examiner*—Leo H. Boudreau
*Assistant Examiner*—Michael Razaui
*Attorney, Agent, or Firm*—Laff, Whitesel, Conte & Saret

[57] ABSTRACT

A helix slow-wave circuit for use in a linear-beam microwave tube device, comprises a first helix formed by a first wire-like member wound in a first sense at a plurality of turns, and a second helix formed by a second wire-like member wound at a plurality of turns in a second sense opposite to the first sense so as to coaxially surround and superpose on the first helix so that the first and second helixes intersect each other at suitable intervals along an axial direction of the helixes. The first helix is fixed to the second helix in at least some of intersecting points between the first and second helixes.

26 Claims, 5 Drawing Sheets

FIG.1
PRIOR ART
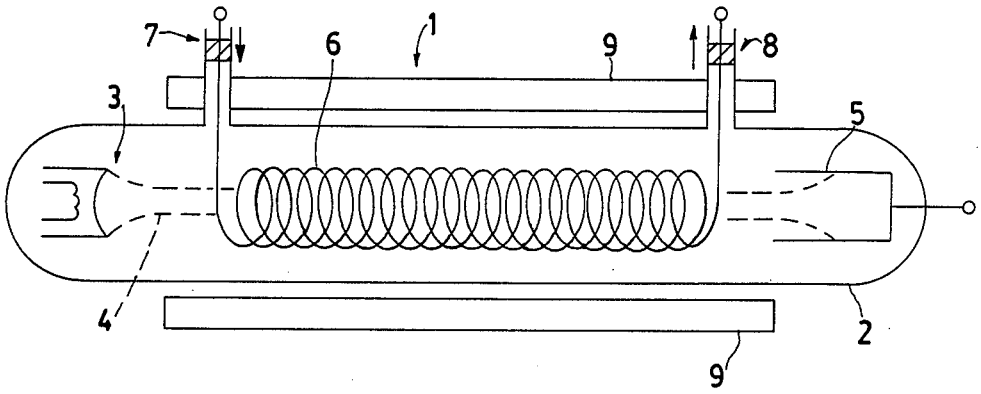
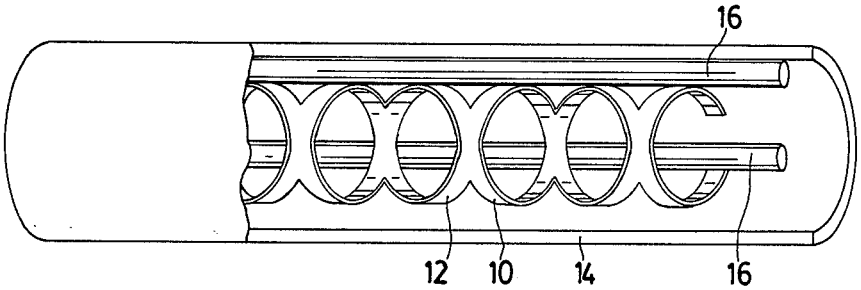
FIG.2
PRIOR ART

CROSSED DOUBLE HELIX SLOW-WAVE CIRCUIT FOR USE IN LINEAR-BEAM MICROWAVE TUBE

BACKGROUND OF THE INVENTION

1. Field of the Invention

The present invention relates to a linear-beam microwave tube such as a traveling wave tube, and more specifically to a crossed double helix slow-wave circuit for use in such a microwave tube.

2. Description of Related Art

Various attempts have heretofore been made to develop high output power, wide band microwave tubes, and different types of microwave tubes are used at present. Among the microwave tubes being used at present, helix slow-wave circuit type traveling wave tubes are most suitable for amplification of microwave frequency band, since the helix type traveling wave tube having a very wide frequency band and can be manufactured at a relatively low cast.

Briefly, as shown in FIG. 1, the helix type traveling wave tube 1 comprises an evacuated envelope 2, as of copper, containing an electron gun assembly 3 at one end thereof for forming and projecting a beam of electrons over an elongated beam path 4 to a electron collector electrode 5 at the opposite end of the envelope 2. A helix slow-wave circuit 6 is arranged along the beam path 4 intermediate the electron gun 3 and the beam collector 5 for electromagnetic interaction with the beam. Input microwave signals to be amplified are applied to the upstream end of the slow-wave circuit 6 via an input coaxial line 7, and amplified output signals are extracted from the downstream end of the slow wave circuit 6 via an output coaxial line 8. A periodic permanent magnetic arrangement 9 is coaxially disposed to surround the envelope 2 for producing an axially directed magnetic beam focusing field within the beam 4 so as to focus the beam throughout the helical slow-wave structure 6.

The traveling wave tube as mentioned above is recently widely used as a final power amplification tube of repeaters provided in earth stations of satellite communication systems. For this purpose, the traveling wave tube is required to be a high output, which inevitably needs a heavy operating current and a high operating voltage. To comply with the high voltage and the heavy current, a sufficient electrode insulation, an effective and sufficient heat dissipation and a required strong electron beam should be ensured, which will result in an increase dimension of the traveling wave tube. On the other hand, traveling wave tubes carried in or mounted on vehicles such as automobiles and aircrafts are required to be small in size, light in weight, a low in power consumption and easy in handling. These requirements of a high output, low power consumption and small size lead to a demand for a high efficiency of the traveling wave tube.

In this circumstance, as shown in FIG. 1 there is used the helix slow-wave circuit 6, which is recently formed of a wound wire or tape of a high melting point metal such as tungsten and molybdenum. This slow-wave circuit is very light in weight and easy in handling.

On the other hand, for high output and high efficiency, the helix slow-wave circuit has to be designed to restrain spatial harmonic components propagating along the helix, to increase a coupling impedance of the basic wave, and to decrease backward traveling wave components.

To fulfill such a requirement, a crossed double helix slow-wave circuit has been proposed. As shown in FIG. 2, the crossed double helix slow-wave circuit is of an integral structure which comprises a first helix portion 10 wound in a right-hand sense and a second helix portion 12 wound in a left-hand sense at the same pitch as that of the first helix portion 10, so that a cylindrical mesh cage is formed as a whole. The crossed double helix is located in a cylindrical portion 14 of the evacuated metal envelope and is supported by a plurality of dielectric rods 16 positioned at equal angular intervals around the helix slow-wave circuit.

With the crossed double helix slow-wave circuit as mentioned above, a pair of propagation modes along the respective helixes 10 and 12 are superimposed in the axial direction of the slow-wave circuit. Thus, an enhanced electric field of basic component will appear in the axial direction of the double helix by cooperation of the two crossed helixes 10 and 12, with the result that the coupling impedance of the slow-wave circuit is improved and the output power of the traveling wave tube is increased.

However, the crossed double helix slow-wave circuit has a complicated shape and configuration as seen from FIG. 2, and therefore, a complicated process is required to manufacture such a crossed double helix. For example, the crossed-double helix can be manufactured by electric discharge machining of a cylindrical metal tube. It will needs a high degree of working precision and a long working time, but a sufficient yield of production would not be obtained. In other words, the crossed double helix has been very expensive, and therefore, has not actually been used in the traveling wave tube.

SUMMARY OF THE INVENTION

Accordingly, it is an object of the present invention to provide a crossed double helix slow-wave circuit which has dissolved the above mentioned drawbacks of the conventional one.

Another object of the present invention is to provide a crossed double helix slow-wave circuit which can be easily and inexpensively manufactured and which has performance not lower than that of the conventional crossed double helix.

Still another object of the present invention is to provide a linear-beam microwave tube of a small-size, lightweight and high efficiency.

A further object of the present invention is to provide a method of easily and inexpensively manufacturing a crossed double helix slow-wave circuit.

A still further object of the present invention is to provide a method of manufacturing a crossed double helix slow-wave circuit of a small-size and light-weight and having performance comparable to the conventional one.

The above and other objects of the present invention are achieved in accordance with the present invention by a helix slow-wave circuit for use in a linear-beam microwave tube device, comprising a first helix formed by a first wire-like member wound in a first sense at a plurality of turns, and a second helix formed by a second wire-like member wound at a plurality of turns in a second sense opposite to the first sense so as to coaxially surround and superpose on the first helix so that the first and second helixes intersect each other at suitable intervals along an axial direction of the helixes, the first helix being fixed to the second helix in at least some of intersecting points between the first and second helixes.

In one embodiment of the crossed double helix slow-wave circuit, the first helix has the form of a circular ring in a view seen from an axial direction of the helix, and the second helix has the form of a circular ring in a view seen from an axial direction of the helix. The circular ring formed by the first helix has an outer diameter substantially equal to an inner diameter of the circular ring formed by the second helix.

In a specific embodiment, the first helix has a resilient restoring force to have in unrestrained condition an outer diameter larger than an inner diameter of the second helix, whereby the first helix is resiliently fixed to the second helix because of the resilient restoring force of the first helix.

Preferably, the first helix is bonded to the second helix in at least some points of the intersecting points between the first and second helixes. Specifically, the first helix is brazed or welded to the second helix in the above mentioned some points.

Alternatively, the first helix is bonded to the second helix at all the intersecting points between the first and second helixes. In this case, preferably, the first helix is brazed or welded to the second helix at all the above mentioned intersecting points.

In another embodiment of the crossed double helix slow-wave circuit, the first helix has the form of a circular ring in a view seen from an axial direction of the helix, and each turn of the second helix has the form of an oval ring in a view seen from an axial direction of the helix, so that the oval ring formed by each turn of the second helix has a minor inner diameter substantially equal to an inner diameter of the circular ring formed by the first helix and a major inner diameter not smaller than an outer diameter of the circular diameter of the circular ring formed by the first helix.

In this case, preferably, the first helix is bonded to the second helix in at least some points of the intersecting points between the first and second helixes. Alternatively, the first helix is bonded to the second helix at all the intersecting points between the first and second helixes.

In a third embodiment, the first helix is wound at equal pitches which are substantially the same as that of the second helix.

In a fourth embodiment, the second helix is wound to surround the first helix at equal pitches which are larger than that of the first helix so that the second helix has substantially the same effective circuit length as that of the first helix.

According to another aspect of the present invention, there is provided a linear beam microwave tube of the type which includes an evacuated envelope containing an electron gun located at one end thereof for providing a beam of electrons, a collector located at the other end of a evacuated envelope for collecting the electron beam from the electron gun, a slow-wave circuit located in the evacuated envelope in such a manner that the electron beams passes through the slow-wave circuit to the collector, and a plurality of support rods located angularly separately from one another in the circumference of the slow-wave circuit and between the slow-wave circuit and an inner surface of the evacuated envelope to extend in the axial direction of the slow-wave circuit thereby to support the slow-wave circuit in the evacuated envelope; means at the upstream side of the electron beam for applying a microwave signal to the electron beam; and means at the downstream side of the electron beam for extracting an amplified output signal from the electron beam; wherein the improvement is that the slow-wave circuit is composed of a crossed double helix which comprises a first helix formed by a first wire-like member wound in a first sense at a plurality of turns, and a second helix formed by a second wire-like member wound at a plurality of turns in a second sense opposite to the first sense so as to coaxially surround and superpose on the first helix so that the first and second helixes intersect each other at suitable intervals along an axial direction of the helixes, the first helix being fixed to the second helix at intersecting points between the first and second helixes.

In one embodiment, the first helix has the form of a circular ring in a view seen from an axial direction of the helix, and the second helix has the form of a circular ring in a view seen from an axial direction of the helix. The circular ring formed by the first helix has an outer diameter substantially equal to an inner diameter of the circular ring formed by the second helix. In addition, the support-rods are located at equal angular intervals in contact between the inner surface of the evacuated envelope and the outer surface of only the second helix.

In this embodiment, the first helix may be wound at equal pitches which are substantially the same as that of the second helix. In this case, it can be so designed that the first helix has a resilient restoring force to have in unrestrained condition an outer diameter larger than an inner diameter of the second helix, whereby the first helix is resiliently fixed to the second helix because of the resilient restoring force of the first helix.

Alternatively, the second helix may be wound to surround the first helix at equal pitches which are larger than that of the first helix so that the second helix has substantially the same effective circuit length as that of the first helix.

In a second embodiment of the microwave tube, the first helix has the form of a circular ring in a view seen from an axial direction of the helix, and each turn of the second helix has the form of an oval ring in a view seen from an axial direction of the helix, so that the oval ring formed by each turn of the second helix has a minor inner diameter substantially equal to an inner diameter of the circular ring formed by the first helix and a major inner diameter not smaller than an outer diameter of the circular diameter of the circular ring formed by the first helix.

In this embodiment, the first helix may be wound at equal pitches which are substantially the same as that of the second helix, so that opposite ends of the major diameters of the respective turns of the second helix stand in a pair of axial straight lines positioned opposite to each other in a diameter direction of the crossed double helix.

In this case, the support rods are located at equal angular intervals in contact between the inner surface of the evacuated envelope and the outer surfaces of the crossed double helix, so that each of the support rods is located a portion of each turn of the second helix other than the major diameter of the oval ring formed by each turn of the second helix so that each of the support rods is contact to the outer surfaces of both the first and second helix.

Alternatively, the support rods are located at equal angular intervals in contact between the inner surface of the evacuated envelope and the outer surfaces of the crossed double helix, so that a least one of the support rods is located in contact with one end of the major diameter of each turn of the second helix with the result that the at least one support rod is out of contact to the first helix.

According to a third aspect of the present invention, there is provided a method of manufacturing a crossed double helix slow-wave circuit for use in a linear-beam microwave tube device, comprising the steps of preparing a mandrel having a cylindrical outer surface, spirally winding a pair of inner wire-like members around the mandrel in a first sense of plurality of turns in such a condition that the pair of the inner wire-like members are in contact with each other and in contact with the outer surface of the mandrel and each turn of the inner wire-like member pair is in contact to adjacent turns, spirally winding an outer wirelike member on the spirally wound inner wire-like member pair in a second sense opposite to the first sense in such a manner that each turn of the spirally wound outer wire-like member is separate from adjacent turns, and removing one of the spirally wound inner wire-like member pair and the mandrel.

In this method, preferably, there is annealed the mandrel wound with the inner wire-like member pair and the outer wire-like member, after winding of the outer wire-like member.

In addition, the spirally wound outer wire-like member is preferably bonded to the remaining spirally wound inner wire-like member in at least some of intersecting points between the inner and outer spirally wound members.

The above and other objects, features and advantages of the present invention will be apparent from the following description of preferred embodiment of the invention with reference to the accompanying drawings.

BRIEF DESCRIPTION OF THE DRAWINGS

FIG. 1 is a schematic longitudinal sectional view of a conventional helix type traveling wave tube;

FIG. 2 is a partial broken longitudinal perspective view of a conventional crossed double helix slow-wave circuit;

DESCRIPTION OF THE PREFERRED EMBODIMENTS

Figure 3:
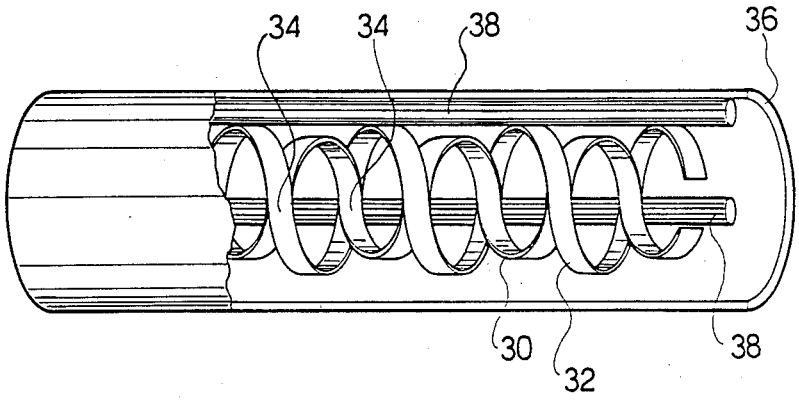
FIG. 3 is a view similar to FIG. 2 showing a first embodiment of the crossed double helix slow-wave circuit in accordance with the present invention.

Referring to FIG. 3, there is shown, in the form of a schematic longitudinal, partially broken, perspective view, a first embodiment of the crossed double helix slow-wave circuit in accordance with the present invention, which can be incorporated in a linear-beam microwave tube such as the traveling wave tube as shown in FIG. 1. The shown crossed double helix comprises a first helix 30 formed by a first wire-like member wound in a left-hand sense at a plurality of turns, and a second helix 32 formed by a second wire-like member wound at a plurality of turns in a right-hand sense so as to coaxially surround and superpose on the first helix 30 so that the first and second helixes intersect each other at constant intervals along an axial direction of the helixes. Specifically, the helixes 30 and 32 are formed of a wire having a circular section or a tape having a rectangular section, which are made of a high melting point metal such as tungsten and molybdenum. Further, as seen from FIG. 3A, the first 30 has the form of a circular ring in a view seen from an axial direction of the helix, and the second helix 32 also has the form of a circular ring in a view seen from an axial direction of the helix. The circular ring formed by the first helix 30 has an outer diameter equal to an inner diameter of the circular ring formed by the second helix 32. Thus, the inner helix 30 and the outer helix 32 intersect and contact each other at every half turn of the helix. In addition, the first helix 30 is fixed, by for example brazing or welding, to the second helix 32 in at least some of intersecting points 34 between the first and second helixes. But, the first and second helixes 30 and 32 are brazed or welded to each other at all the intersecting points 34 between the first and second helixes.

Figure 3A:
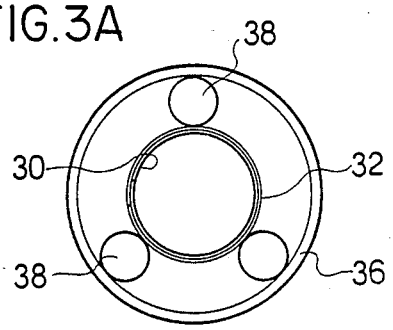
FIG. 3A is an end view of the slow-wave circuit shown in FIG. 3.

The crossed double helix as mentioned above is located in the evacuated metal envelope 36 of the traveling wave tube and supported by a plurality of dielectric rods (for example, three or four rods) located at equal angular intervals around the crossed double helix and between the inner surface of the metal envelope 36 and the outer surface of the outer helix 32 in contact thereto, as seen from FIG. 3A.

Instead of brazing or welding the first and second helixes, the first helix 30 can be fixed to the second helix 32 by use of resilience of the first helix 30. For this purpose, the first helix 30 is so designed to hvae in unrestrained condition an outer diameter somewhat larger than an inner diameter of the second helix 32. The first helix 30 thus formed is compressed by a suitable jig to have an outer diameter less than the inner diameter of the second helix 32, and the compressed first helix 30 is inserted in place in the second helix 32. Thereafter, by removing the commpression of the first helix, the first helix is expanded and then resiliently fixed to the second helix because of the resilient restoring force of the first helix. Thus, the first helix 30 is resiliently firmly fixed to the second helix 32 at each intersecting point 34 along the full length of the helix.

In the embodiment shown in FIG. 3, the first and second helixes 30 and 32 are wound at the same pitch but the second helix 32 has a diameter larger than that of the first helix 30 by a diameter or thickness of the wire member of helix. Therefore, the first and second helixes 30 and 32 have different circuit lengths. In this case, the electromagnetic waves along the respective helixes are different in effective propagation mode in the axial direction of the crossed double helix. This difference of phase will weaken the effective composite field of the basic wave in the axial direction of the slow-wave circut. As a result, the coupling impedance and hencethe output will be decreased. Namely, an inherent advantage of the crossed double helix slow-wave circuit cannot be perfectly exerted.

Figure 4:
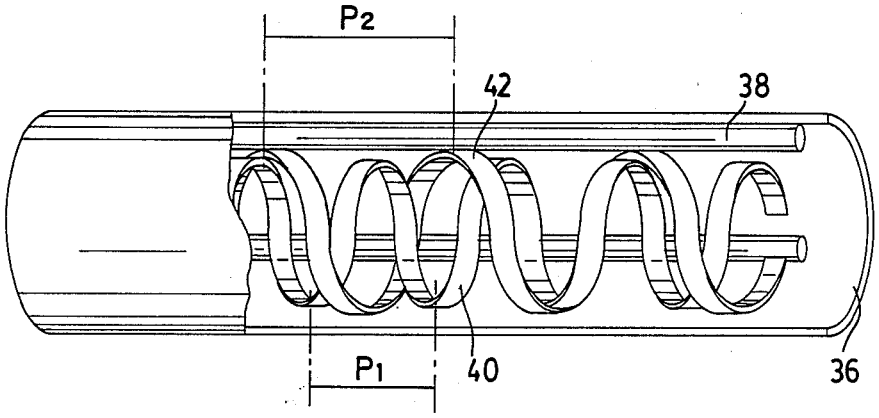
FIG. 4 is a view similar to FIG. 2 but showing a second embodiment of the crossed double helix slow-wave circuit in accordance with the present invention.

For dissolving this inconvenience, as shown in FIG. 4, the crossed double helix can be so designed that an outer helix 42 is wound at equal pitches $P_2$ which are larger than that $P_1$ of an inner helix 40 so that the two helixes 40 and 42 have substantially the same effective circuit length.

In this case, the following equation should be fulfilled by the respective pitches $P_1$ and $P_2$:

$$P_2 = \frac{l_2}{l_1} P_1$$

where $l_1$ and $l_2$ are respectively the developed lengths of inner and outer helixes when the outer helix is wound on the inner helix at the same pitch as that of the inner helix.

With this arrangement, the basic wave commponents propagating along the respecting helixes 40 and 42 have the same phase in the axial direction of the crossed double helix, so that the inherent advantage of the crossed double helix will be exerted without any loss.

Figure 5:
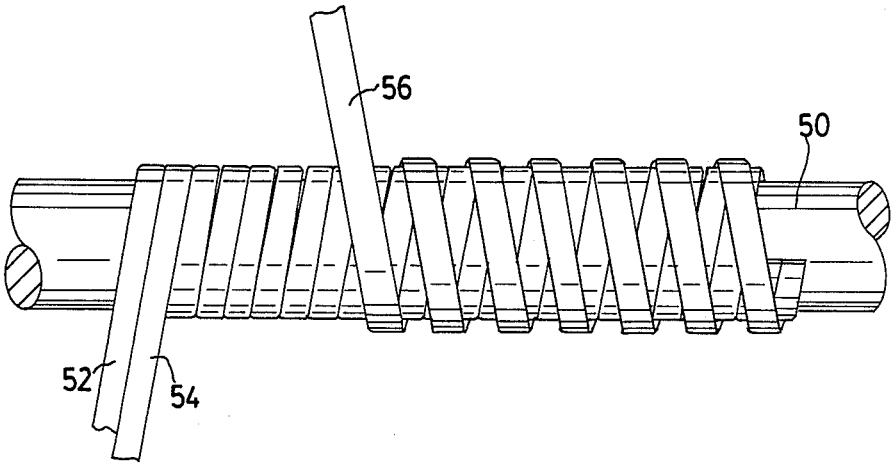
FIG. 5 is a perspective view of a wire double-wound mandrel, illustrating the method in accordance with the present invention of manufacturing the crossed double helix slow-wave circuit.

The crossed double helix shown in FIGS. 3 and 4 can be manufactured as shown in FIG. 5. Firstly, there is prepared an mandrel 50 made of a heat resistive material and having a cylindrical outer surface of a diameter equal to the inner diameter of a crossed double helix to be produced. This mandrel 50 has a sufficient axial length larger than that of the crossed double helix to be produced. A pair of inner wire-like members 52 and 54 are spirally wound around the mandrel 50 in a first sense a plurality of turns in such a condition that the pair of the inner wire-like members 52 and 54 are in contact with each other and in contact with the outer surface of the mandrel 50 and each turn of the inner wire-like member pair is in contact to adjacent turns. Namely, the pair of wires 52 and 54 are closely wound on the mandrel 50. Thereafter, an outer wire-like member 56 is spirally wound on the spirally wound inner wire-like member pair 52 and 54 in a second sense opposite to the first sense at such a sufficient constant pitch that each turn of the spirally wound outer wire-like member 56 is separate from adjacent turns.

In this condition, the double wound helix are temporarily secured at opposite ends of the mandrel 50 by a suitable clamp means (not shown).

The mandrel 50 thus wound with the wire members 52, 54 and 56 is loaded in an inert gas furnace such as a hydrogen furnace, so that the wire members are heated to be annealed. With the annealing, internal stress is removed from the double wound helix, so that the helixes 52, 54 and 56 will maintain their shapes, particularly their diameters even if the clamps means are removed.

Thereafter, the clamp means are detached from the mandrel 50, and if necessary, the double wound helix is cut to a desired length. Then, the mandrel 50 is removed, and one of the inner helixes 52, i.e., a dummy wire is removed.

The crossed double helix thus formed has a rightwardly wound helix and a leftwardly wound helix superposed on each other. But, the two helixes are only mechanically fixed to each other. Therefore, for mechanical stabilization, the two helixes are bonded by for example brazing or welding in at least some of intersecting points, preferably at all the intersecting points.

In the above mentioned method, the size of the inner wire (dummy wire) 52 which will be removed at the last stage is determined by the pitch and the wire diameter of the inner helix 54 (or the width and the thickness of the inner helix wire 54 in the case of the tape-like wire). Namely, when the round wire 54 (inner helix) and a tape-like wire 52 (dummy) are used, the following relation should be fulfilled:

$$A \leqq p - d$$

$$B = d$$

where p: pitch of the inner helix d: diameter of the round wire of the inner helix A: width of the dummy wire B: thickness of the dummy wire But, if A is larger than B, as the dummy wire a round wire can be used which has a diameter equal to that of the round wire of the inner helix.

Thus, the inner helix can be wound at equal pitches along the axial direction, and the outer helix can have a section of a true circle.

Figure 6:
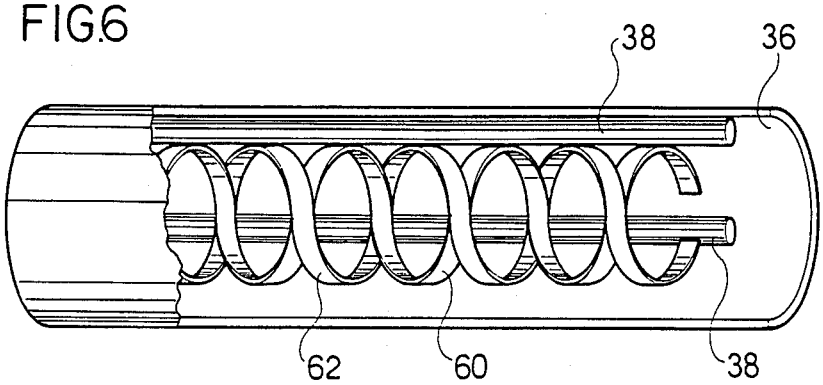
FIG. 6 is a view similar to FIG. 2 but showing a third embodiment of the crossed double helix slow-wave circuit in accordance with the present invention.
Figure 7:
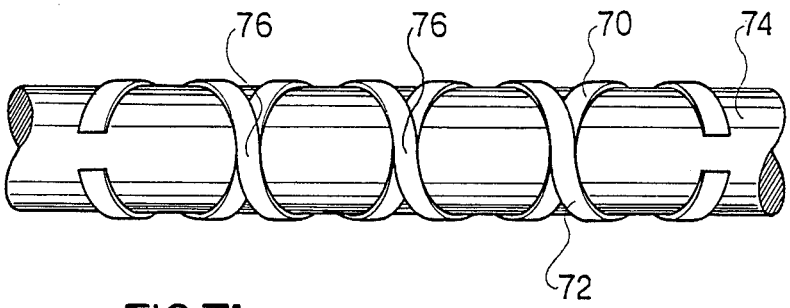
FIG. 7 is a view similar to FIG. 5 but showing a method of manufacturing the crossed double helix shown in FIG. 6.
Figure 7A:
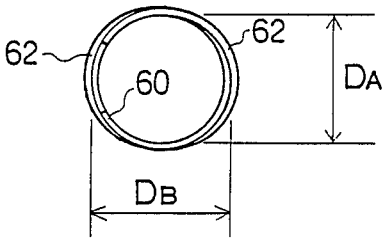
FIG. 7A is an end view of the crossed double helix shown in FIG. 6.

Referring to FIG. 6, there is shown a still another embodiment of the crossed double helix, which comprises a first helix 60 formed by a first wire-like member wound in a left-hand sense at a plurality of turns, and a second helix 62 formed by a second wire-like member wound at a plurality of turns in a right-hand sense so as to coaxially surround and superpose on the first helix so that the first and second helixes intersect each other at suitable intervals along an axial direction of the helixes. Specifically, as shown in FIG. 7A, the first helix 60 has the form of a circular ring in a view seen from an axial direction of the helix, and each turn of the second helix 62 has the form of an oval ring in a view seen from an axial direction of the helix. The oval ring formed by each turn of the second helix 62 has a minor inner diameter $D_A$ substantially equal to an inner diameter of the circular ring formed by the first helix 60 and a major inner diameter $D_B$ substantially equal to an outer diameter of the circular diameter of the circular ring formed by the first helix 60.

The above crossed double helix can be formed as follows: Namely, a wire 70 for the inner helix 60 is wound around a mandrel 74 similar to the mandrel 50 shown in FIG. 5, in a first sense at a predetermined constant pitch, and then, a wire 72 for the outer helix 62 is wound around the mandrel 74 in a second sense opposite to the first sense at another constant pitch, which can be the same as or different from the constant pitch of the inner helix 60. Particularly, in the winding of the second wire 72, the wire 72 is tightly wound on the mandrel 74 so that the wire 72 is in contact wiht the surface of the mandrel 74 excluding intersecting portions 76 between the wires 70 and 72.

In this condition, the wires 70 and 72 are firmly secured to the mandrel 74 by a suitable clamp means (not shown), and then annealed in for example a hydrogen furnace, so that the internal stress is removed. Thereafter, the mandrel is removed and the crossed double helix thus formed is cut to a desired length, if necessary.

In the crossed double helix formed as mentioned above, the inner helix 60 (70) and the outer helix 62 (72) are fixed to each other by only mechanical contact. For a mechanical stabilization, the first helix 60 is bonded by for example brazing or welding to the second helix 62 in at least some points of the intersecting points 76 between the first and second helixes.

Figure 8:
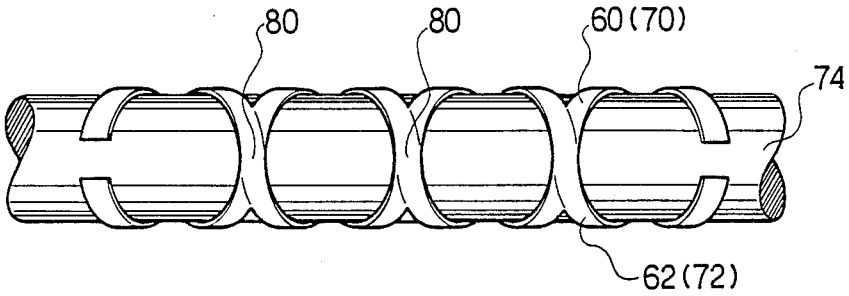
FIGS. 8 and 9 are views similar to FIG. 5 but showing different methods of manufacturing the crossed double helix shown in FIG. 6.
Figure 9:
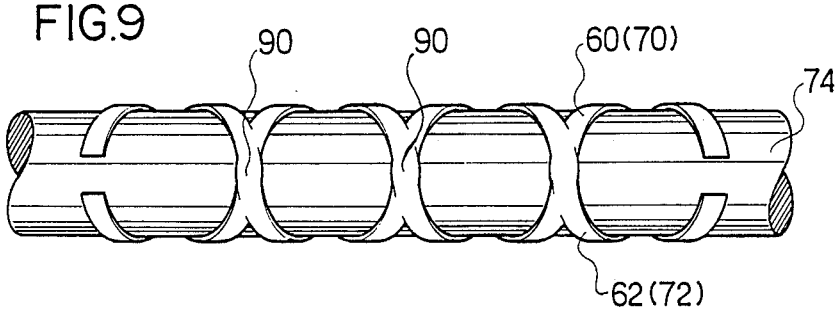

But, for more complete mechanical stability, the first helix 66 is welded to the second helix 62 at all the intersecting points 80 as shown in FIG. 8. Alternatively, the first helix 60 is brazed to the second helix 62 at all the intersecting points 90 as shown in FIG. 9.

In the above slow-wave circuit, if the first helix 60 is wound at equal pitches which are substantially the same as that of the second helix 62, so that opposite ends of the major diameters $D_B$ of the respective turns of the second helix 62 stand in a pair of axial straight lines positioned opposite to each other in a diameter direction of the crossed double helix.

Figure 10:
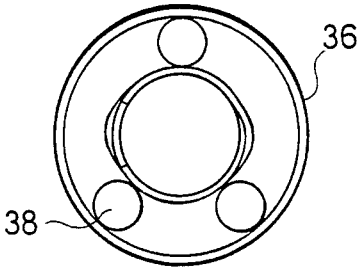
FIGS. 10 and 11 are end views of the crossed double helix slow-wave circuit located in the evacuated envelope of the traveling wave tube, illustrating the manner of supporting the crossed double helix by support rods.

In this condition, as shown in FIG. 10, the support rods 38 can be located at equal angular intervals (120°) in contact between the inner surface of the evacuated envelope 36 and the outer surfaces of the crossed double helix, in such a manner that each of the support rods is located at a portion of each turn of the second helix other than the intersecting portions of the two helixes, i.e., the major diameter $D_B$ portion of the oval ring formed by each turn of the second helix. With this arrangement, each of the support rods is in contact to the outer surfaces of both the first and second helixes.

Figure 11:
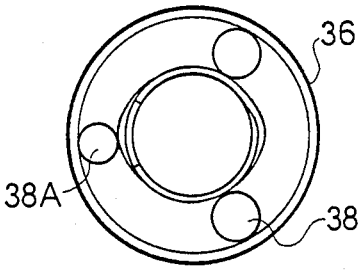

Alternatively, as shown in FIG. 11, the support rods 38 are located at equal angular intervals (120°) in contact between the inner surface or the evacuated envelope 36 and the outer surfaces of the crossed double helix, in such a manner that at least one of the support rods 38A is located in contact with one of the axially aligned intersecting portions, i.e., one end of the major diameter of each turn of the second helix 62 so that the one support rod 38A is out of contact to the first helix 60.

As seen from the above, the crossed double helix slow-wave circuit can be simply and inexpensively manufactured to have a sufficient mechanical strength and hence an improved heat-resistance. Therefore, a traveling wave tube incorporating such a crossed double helix slow-wave circuit can have a stable and excellent frequency characteristics and a high efficiency.

The invention has thus been shown and described with reference to specific embodiments. However, it should be noted that the invention is in no way limited to the details of the illustrated structures but changes and modifications may be made within the scope of the appended claims.

We claim:

1. A helix slow-wave circuit for use in a linear-beam microwave tube device, comprising a first helix formed by a first wire-like member wound in a first sense at a plurality of turns, said first helix having a circular cross section when viewed along an axis thereof, and a second helix formed by a second wire-like member wound on the first helix at a plurality of turns in a second sense which is opposite to the first sense so as to coaxially superpose on the first helix and to overlie on the first helix at all intersecting portions so that the first and second helixes intersect each other at suitable intervals along an axial direction of the helixes, said second helix having a non-circular cross section when viewed along an axis thereof, whereby the first and second helixes are not in axial symmetry with respect to each other, the first helix being fixed to the second helix in at least some intersecting points between the first and second helixes, wherein the first helix has a resilient restoring force to have in an unrestrained condition an outer diameter which is larger than an inner diameter of the second helix, whereby the first helix is resiliently fixed to the second helix because of the resilient restroing force of the first helix.

2. A helix slow-wave circuit for use in a linear-beam microwave tube device, comprising a first helix formed by a first wire-like member wound in a first sense at a plurality of turns, said first helix having a circular cross section when viewed along an axis thereof, and a second helix formed by a second wire-like member wound on the first helix at a plurality of turns in a second sense which is opposite to the first sense so as to coaxially superpose on the first helix and to overlie on the first helix at all intersecting portions so that the first and second helixes intersect each other at suitable intervals along an axial direction of the helixes, said second helix having a non-circular cross section when viewed along an axis thereof, whereby the first and second helixes are not in axial symmetry with respect to each other, the first helix being bonded to the second helix in at least some of the intersecting points between the first and second helixes.

3. A helix slow-wave circuit claimed in claim 2 wherein the first helix is brazed to the second helix in the above mentioned at least some points.

4. A helix slow-wave circuit claimed in claim 2 wherein the first helix is welded to the second helix in the above mentioned at least some points.

5. A helix slow-wave circuit claimed in claim 2 wherein the first helix is bonded to the second helix at all the intersecting points between the first and second helixes.

6. A helix slow-wave circuit claimed in claim 5 wherein the first helix is brazed to the second helix at all the above mentioned intersecting points.

7. A helix slow-wave circuit claimed in claim 5 wherein the first helix is welded to the second helix at all the above mentioned intersecting points.

8. A helix slow-wave circuit for use in a linear-beam microwave tube device, comprising a first helix formed by a first wire-like member wound in a first sense at a plurality of turns, said first helix having a circular cross section when viewed along an axis thereof, and a second helix formed by a second wire-like member wound on the first helix at a plurality of turns in a second sense which is opposite to the first sense so as to coaxially superpose on the first helix and to overlie on the first helix at all intersecting portions so that the first and second helixes intersect each other at suitable intervals along an axial direction of the helixes, said second helix having a non-circular cross section when viewed along an axis thereof, whereby the first and second helixes are not in axial symmetry with respect to each other, the first helix being fixed to the second helix in at some intersecting points between the first and second helixes, the first helix being wound at equal pitches which are substantially the same as the pitches of the second helix.

9. A helix slow-wave circuit claimed in claim 8 wherein the first helix has a resilient restoring force to have in unrestrained condition an outer diameter larger than an inner diameter of the second helix, whereby the first helix is resiliently fixed to the second helix because of the resilient restoring forces of the first helix.

10. A helix slow-wave circuit claimed in claim 8 wherein the first helix is bonded to the second helix in at least some points of the intersecting points between the first and second helixes.

11. A helix slow-wave circuit claimed in claim 8 wherein the first helix is bonded to the second helix at all the intersecting points between the first and second helixes.

12. A helix slow-wave circuit for use in a linear-beam microwave tube device, comprising a first helix formed by a first wire-like member wound in a first sense at a plurality of turns, said first helix having a circular cross section when viewed along an axis thereof, and a second helix formed by a second wire-like member wound on the first helix at a plurality of turns in a second sense which is opposite to the first sense so as to coaxially superpose on the first helix and to overlie on the first helix at all intersecting portions so that the first and second helixes intersect each other at suitable intervals along an axial direction of the helixes, said second helix having a non-circular cross section when viewed along an axis thereof, whereby the first and second helixes are not in axial symmetry with respect to each other, the second helix being wound to surround the first helix at equal pitches which are larger than the pitches of the first helix so that the first and the second helixes have substantially the same effective circuit length.

13. A helix slow-wave circuit claimed in claim 12 wherein the first helix has a resilient restoring force to have in unrestrained condition an outer diameter larger than an inner diameter of the second helix, whereby the first helix is resiliently fixed to the second helix because of the resilient restoring force of the first helix.

14. A linear beam microwave tube of the type which includes an evacuated envelope containing an electron gun located at one end thereof for providing a beam of electrons, a collector located at the other end of the evacuated envelope for collecting the electron beam from the electron gun, a slow-wave circuit located in the evacuated envelope in a position wherein the electron beam passes through the slow-wave circuit to the collector, a plurality of support rods located angularly separated from one another in the circumference of the slow-wave circuit and between the slow-wave circuit and an inner surface of the evacuated envelope to extend in the axial directon of the slow-wave circuit and support the slow-wave circuit in the evacuated envelope; means at the upstream side of the electron beam for applying a microwave signal to the electron beam; means at the downstream side of the electron beam for extracting an amplified output signal from the electron beam; wherein the improvement is that the slow-wave circuit is composed of a crossed double helix which comprises a first helix formed by a first wire-like member wound in a first sense with a plurality of turns, and a second helix formed by a second wire-like member wound with a plurality of turns and in a second sense which is opposite to the first sense so as to coaxially surround and superpose on the first helix so that the first and second helixes intersect each other at suitable intervals along an axial direction of the helixes, the first helix being fixed to the second helix at intersecting points between the first and second helixes, the first helix having a cross section in the form of a circular ring when viewed along an axial direction of the helix, and each turn of the second helix has the form of an oval ring when viewed along an axial direction of the helix, the oval ring formed by each turn of the second helix having a minor inner diameter substantially equal to an inner diameter of the circular ring formed by the first helix and a major inner diameter which is not smaller than an outer diameter of the circular diameter of the circular ring formed by the first helix.

15. A microwave tube claimed in claim 14 wherein the first helix is wound at equal pitches which are substantially the same as that of the second helix, so that opposite ends of the major diameters of the respective turns of the second helix stand in a pair of axial straight lines positioned opposite to each other in a diameter direction of the crossed double helix.

16. A microwave tube claimed in claim 15 wherein the support rods are located at equal angular intervals in contact between the inner surface of the evacuated envelope and the outer surfaces of the crossed double helix, each of the support rods being located a portion of each turn of th e second helix other than the major diameter of the oval ring formed by each turn of the second helix so that each of the support rods is contact to the outer surfaces of both the first and second helixes.

17. A microwave tube claimed in claim 16 wherein the first helix is bonded to the second helix in at least some points of the intersecting points between the first and second helixes.

18. A microwave tube claimed in claim 16 wherein the first helix is bonded to the second helix at all the intersecting points between the first and second helixes.

19. A microwave tube claimed in claim 16 wherein the first helix has a resilient restoring force to have in unrestrained condition an outer diameter larger than an inner diameter of the second helix, whereby the first helix is resiliently fixed to the second helix because of the resilient restoring force of the first helix.

20. A microwave tube claimed in claim 15 wherein the support rods are located at equal angular intervals in contact between the inner surface of the evacuated envelope and the outer surfaces of the crossed double helix, at least one of the support rods being located in contact with one end of the major diameter of each turn of the second helix so that the at least one support rods is out of contact to the first helix.

21. A microwave tube claimed in claim 20 wherein the first helix is bonded to the second helix in at least some points of the intersecting points between the first and second helixes.

22. A microwave tube claimed in claim 20 wherein the first helix is bonded to the second helix at all the intersecting points between the first and second helixes.

23. A method of manufacturing a crossed double helix slow-wave circuit for use in a linear-beam microwave tube device, comprising the steps of preparing a mandrel having a cylindrical outer surface, spirally winding a pair of inner wire-like members around the mandrel in a first sense with a plurality of turns in such a condition that the pair of the inner wire-like members are in contact with each other and in contact with the outer surface of the mandrel and with each turn of the inner wire-like member pair in contact with adjacent turns, spirally winding an outer wire-like member on the spirally wound inner wire-like member pair in a second sense opposite to the first sense in such a manner that each turn of the spirally wound outer wire-like member is separate from adjacent turns, annealing the mandrel wound with the inner wire-like member pair and the outer wire-like member, after winding of the outer wire-like member, removing one of the spirally wound inner wire-like member pair and the mandrel, and bonding the spirally wound outer wire-like member to the remaining spirally wound inner wire-like member in at least some of intersecting points between the inner and outer spirally wound members.

24. A method claimed in claim 23 wherein the bonding is realized by brazing.

25. A method claimed in claim 23 wherein the bonding is realized by welding.

26. A method claimed in claim 23 further including the step of bonding the spirally wound outer wire-like member to the remaining spirally wound inner wire-like member at all intersecting points between the inner and outer spirally wound members.

* * * * *